US007736176B2

(12) United States Patent
Zhang et al.

(10) Patent No.: US 7,736,176 B2
(45) **Date of Patent: *Jun. 15, 2010**

(54) MODULAR JACK ASSEMBLY HAVING IMPROVED CONNECTING TERMINAL

(75) Inventors: Hong-Bo Zhang, Kunshan (CN); Zheng-Hua Xu, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 65 days.

This patent is subject to a terminal disclaimer.

(21) Appl. No.: 12/074,360

(22) Filed: Mar. 3, 2008

(65) Prior Publication Data

US 2008/0214057 A1 Sep. 4, 2008

(30) Foreign Application Priority Data

Mar. 2, 2007 (CN) ..... 2007 2 0034865

(51) Int. Cl.
*H01R 13/73* (2006.01)

(52) U.S. Cl. ..... 439/541.5; 439/76.1; 439/620.12

(58) Field of Classification Search ..... 439/668, 439/540.1, 541.5, 620.12, 76.1
See application file for complete search history.

(56) References Cited

U.S. PATENT DOCUMENTS 7,052,315 B2 5/2006 Murr et al.
7,517,254 B2 * 4/2009 Zhang et al. ..... 439/668

* cited by examiner

*Primary Examiner*—Tho D Ta
*Assistant Examiner*—Travis Chambers
(74) *Attorney, Agent, or Firm*—Ming Chieh Chang; Wei Te Chung; Andrew C. Cheng

(57) ABSTRACT

A modular jack assembly for being mounted on a mother board (4) and engaging with a mating plug. The modular jack includes a terminal module (3) having a base element (310) and a power over ethernet assembly (33) mounted to the base element. The base element defines a number of terminal slots (3132) and has a number of connecting terminals (35) mounted thereto. Each connecting terminal has a first end (351) exposed at a side of the base element and a second end (352) connected with the power over ethernet assembly.

16 Claims, 7 Drawing Sheets

MODULAR JACK ASSEMBLY HAVING IMPROVED CONNECTING TERMINAL

BACKGROUND OF THE INVENTION

The present application is related to commonly assigned patent application entitled "MODULAR JACK ASSEMBLY HAVING IMPROVED BASE ELEMENT".

FIELD OF THE INVENTION

The present invention relates to a modular jack assembly and particularly to a modular jack assembly comprising an improved connecting terminal.

DESCRIPTION OF THE PRIOR ART

Modular jack assembly is commonly used in the computer or network appliance as input/output port for transmitting data or signals. An example of such a connector is disclosed in U.S. Pat. No. 7,052,315 issued on May 30, 2006. The modular jack assembly engages with a mating plug and includes an insulative housing, a terminal module received in the housing, a main board mounted to the rear of the insulative housing and a power over ethernet assembly. The terminal module includes a base element defining a receiving room and a conductive portion assembled to a front wall of the base element. The base element comprises a printed circuit board positioned on a top thereof. The terminal module has a plurality of L-shaped signal contacts and power contacts. The L-shaped contacts have first ends routed through the printed circuit board and second ends extending outwardly from a rear wall of the connecting portion and then through the main board for electrically connecting with the power over ethernet assembly.

However, during assembling, the first ends and the second ends of the L-shaped contacts are respectively inserted through the printed circuit board and the main board by strong mechanical force that would result in cracks of the contacts and would complicate the manufacture of the modular jack assembly.

Hence, an improved modular jack assembly is needed to solve the above problem.

BRIEF SUMMARY OF THE INVENTION

One object of the present invention is to provide a modular jack assembly comprising a terminal module having an improved connecting terminal adapted for being assembled to the terminal module easily and being fixed in corresponding terminal slots firmly.

The present invention provides a modular jack assembly for being mounted on a mother board and engaging with a mating plug. The modular jack assembly comprises a plurality of terminal modules, an outer shield surrounding the insulative housing, a power over ethernet assembly mounted rearwardly. The terminal module comprises a contacting module, a base element, a connecting element, a pair of daughter boards assembled to opposite sides of the base element and a plurality of connecting terminals mounted to the base element. The base element defines a plurality of terminal slots at an outer face thereof for receiving the connecting terminals. Each connecting terminal has a first end exposed at a side of the base element, a second end connected with the power over ethernet assembly and a plurality of protrusions disposed thereon for interfering with the terminal slots.

Thus, the connecting terminals are easy to be mounted into the terminal slot in an outer-to-inner direction and firmly fixed in the terminal slots by the interference between the protrusions of the connecting terminals and the terminal slots.

Other objects, advantages and novel features of the invention will become more apparent from the following detailed description of the present embodiments when taken in conjunction with the accompanying drawings.

DETAILED DESCRIPTION OF THE INVENTION

Figure 1:
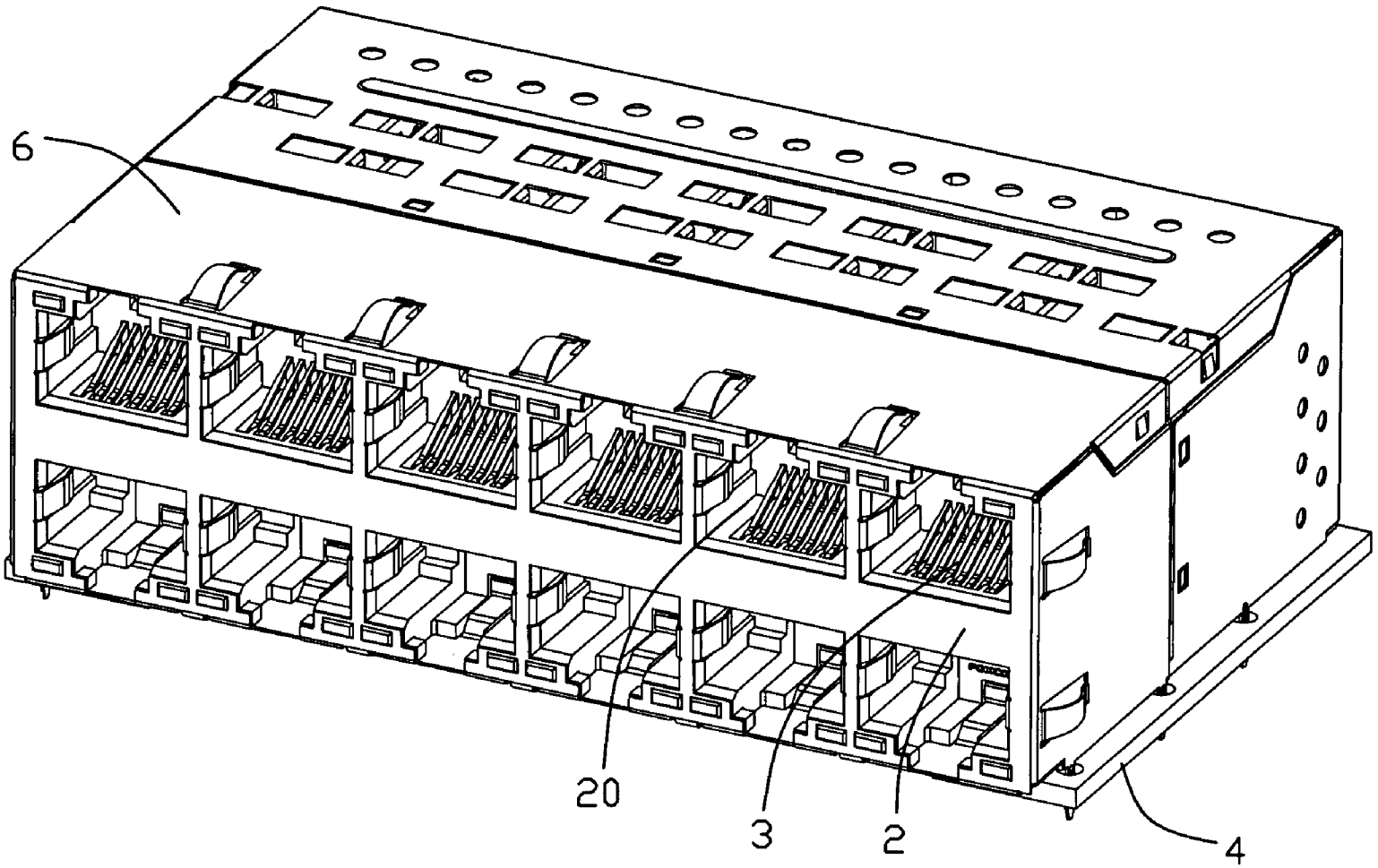
FIG. 1 is an assembled view of the modular jack assembly mounted on a mother board.
Figure 2:
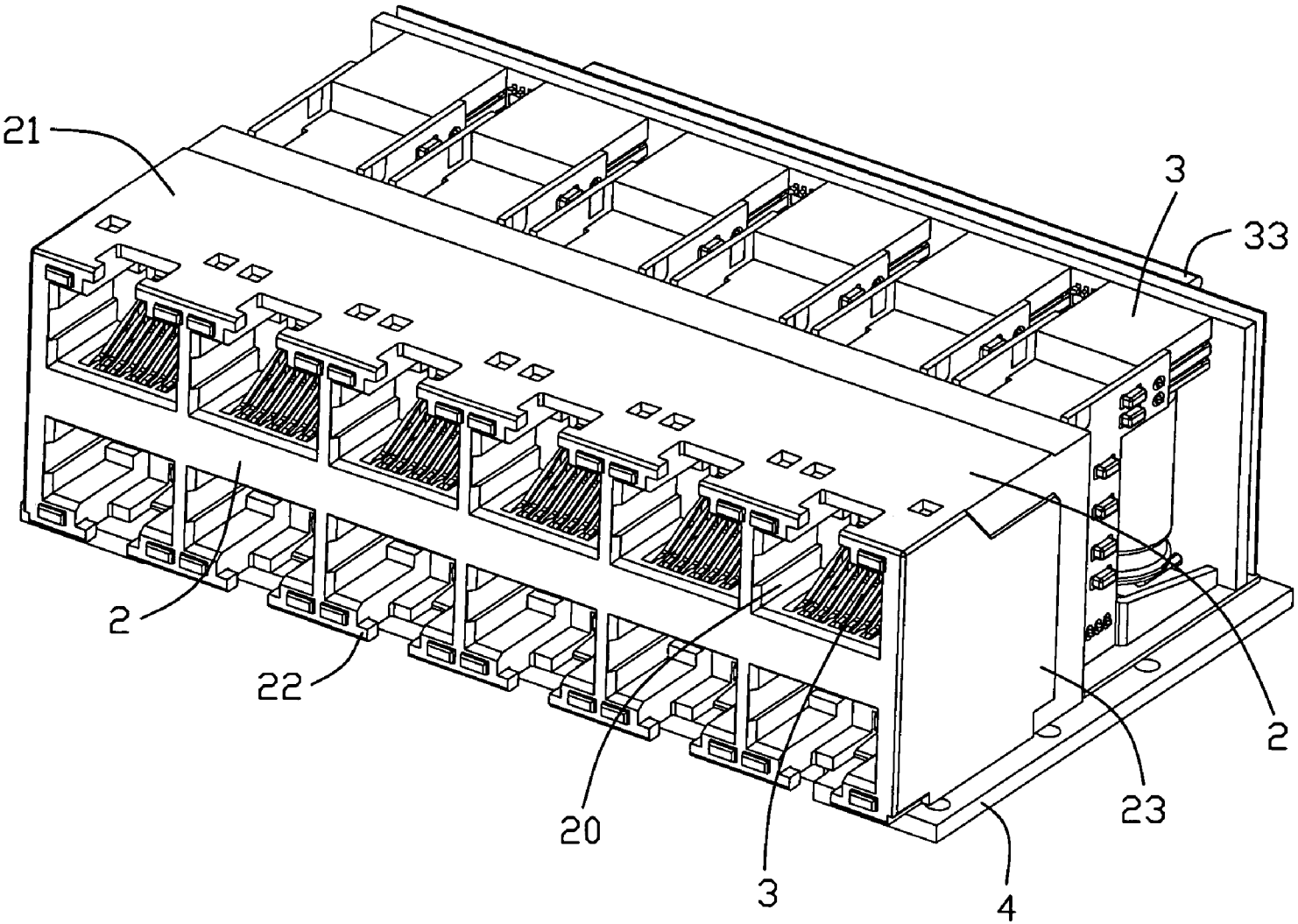
FIG. 2 is a partially assembled view of the modular jack assembly mounted on the mother board, with an outer shield being removed.
Figure 3:
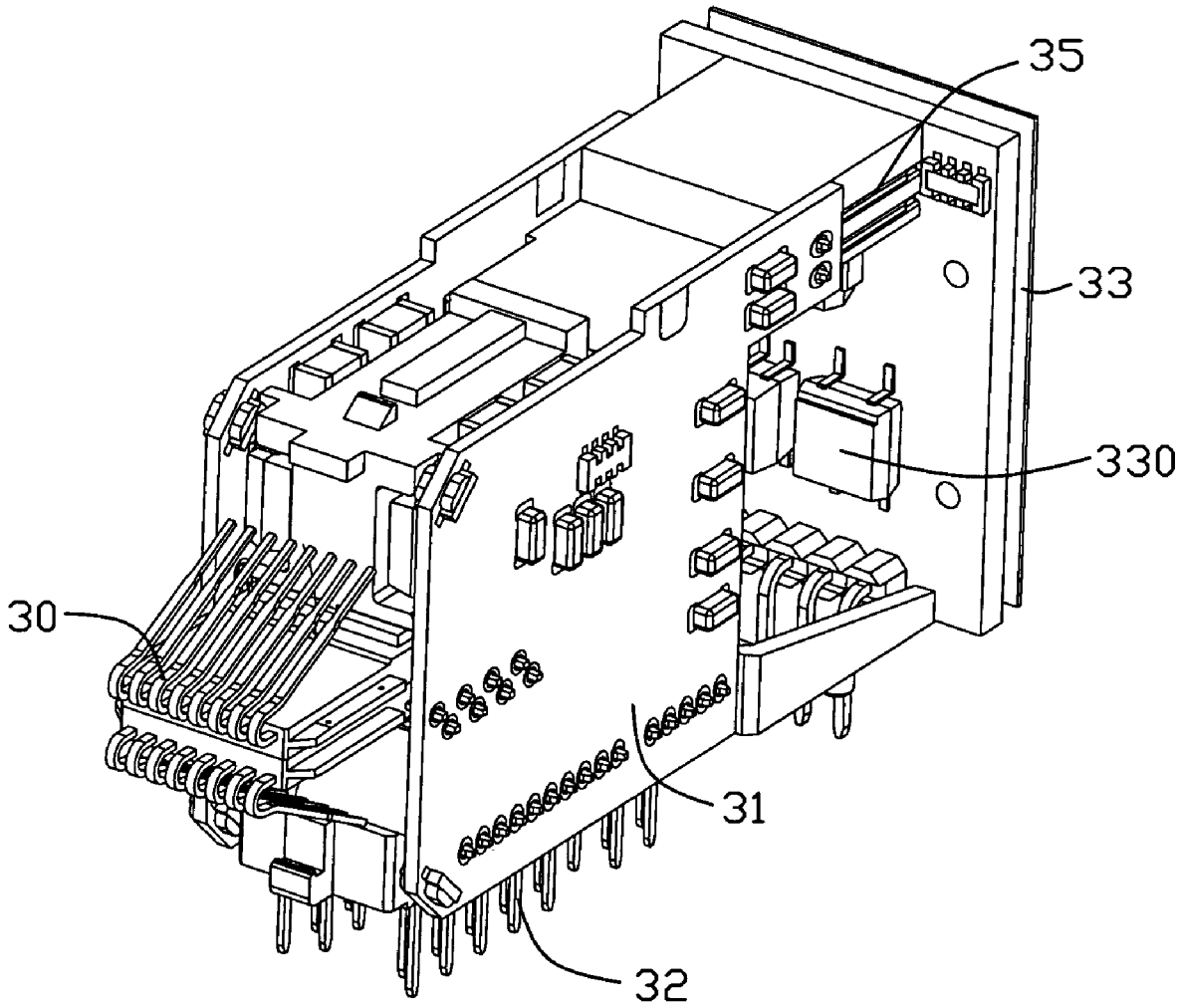
FIG. 3 is an assembled perspective view of a terminal module which is connected with a power over ethernet assembly.

Reference will now be made to the drawing figures to describe the present invention in detail. Referring to FIGS. 1-3, a modular jack assembly 1 for being mounted on a mother board 4 and engaging with a mating plug (not shown) comprises an insulative housing 2, a plurality of terminal modules 3 mounted in the insulative housing 2, a power over ethernet assembly 33 rearwardly assembled to the terminal module 3 and an outer shield 6 surrounding the insulative housing 2.

Figure 4:
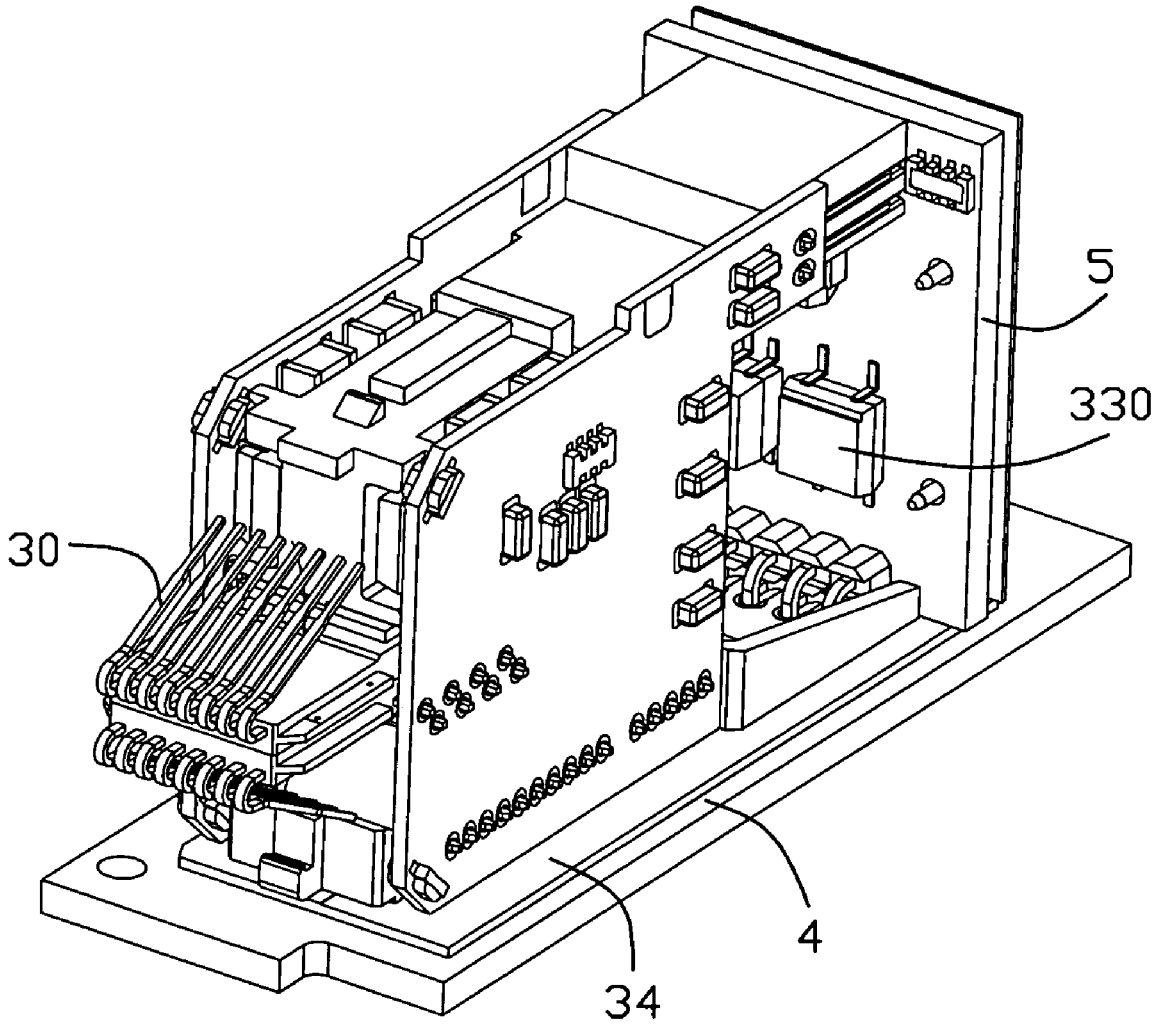
FIG. 4 is an assembled perspective view of the terminal module which is connected with the power over ethernet assembly and the mother board.

Referring to FIGS. 2-4, the insulative housing 2 has a pair of lateral walls 23, a top wall 21, and a bottom wall 22 and defines a plurality of cavities 20 for receiving the mating plugs. The power over ethernet assembly 33 is provided with a substrate 5 and a plurality of electrical elements 330 mounted to the substrate 5.

As shown in FIGS. 1-7, the terminal module 3 is mounted in the cavity 20 of the insulative housing 2 and comprises a contacting module 30, a base element 310, a pair of daughter boards 311 having a plurality of magnetic cores 312 mounted thereon, and a connecting element 32. The terminal module 3 further has a plurality of connecting terminals 35 mounted to the base element 310. The connecting element 32 is mounted to a bottom portion of base element 310 for connecting with the mother board 4.

The contacting module 30 is mounted to the base element 310. The contacting module 30 has a rectangular housing 301 and two groups of mating terminals 302 in the rectangular housing 301. The mating terminals 302 have a plurality of contacting portions 3022 received in the cavities 20 of the insulative housing 2 for electrically connecting with the mating plug, and a plurality of tail portions 3021 extending perpendicularly from the rectangular housing 301 into a plurality of second holes 3110 disposed on the daughter board 311, thereby forming a conductive trace between the daughter board 311 and the contacting module 30.

Figure 5:
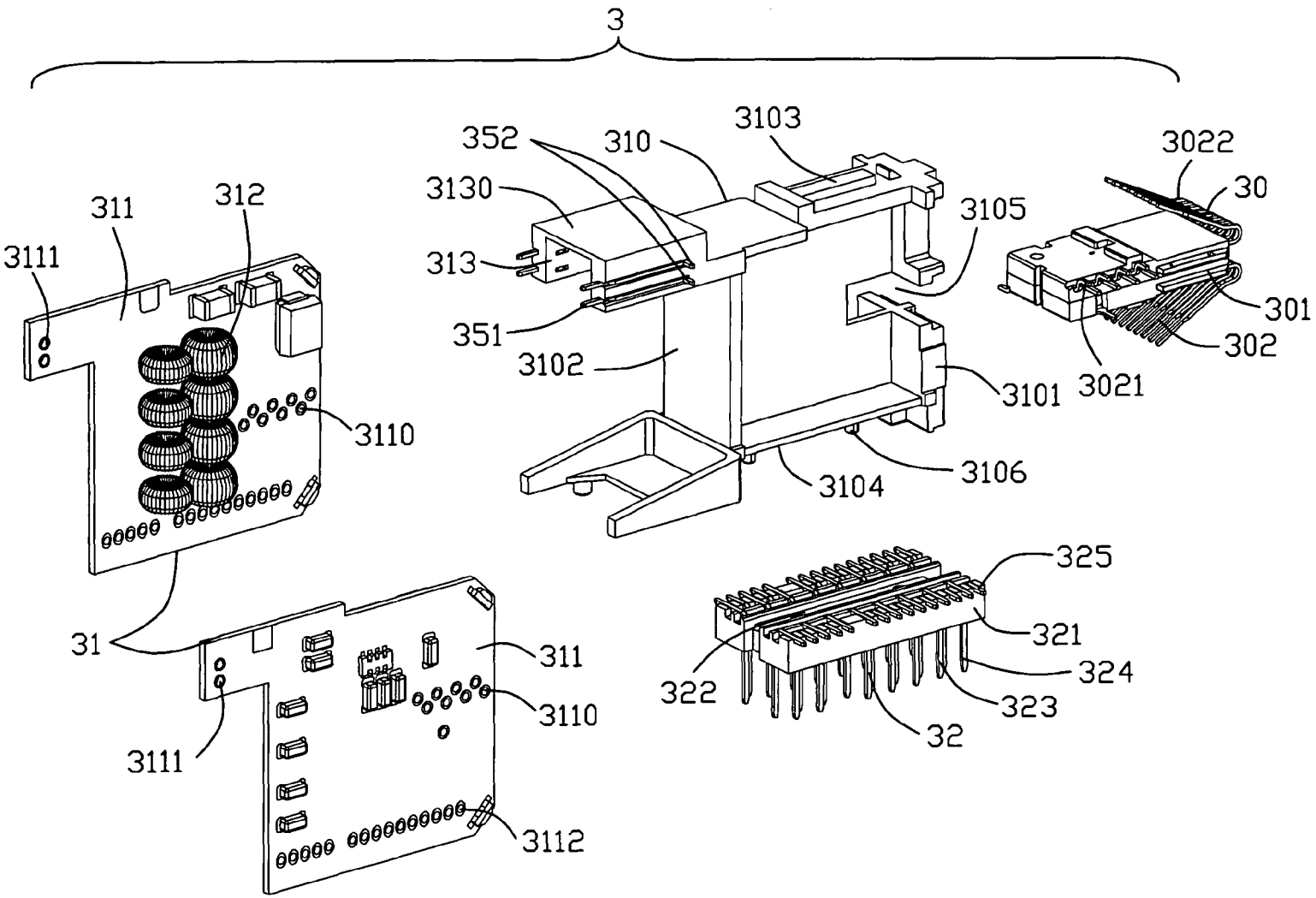
FIG. 5 is an exploded view of the terminal module as shown in FIG. 3.
Figure 6:
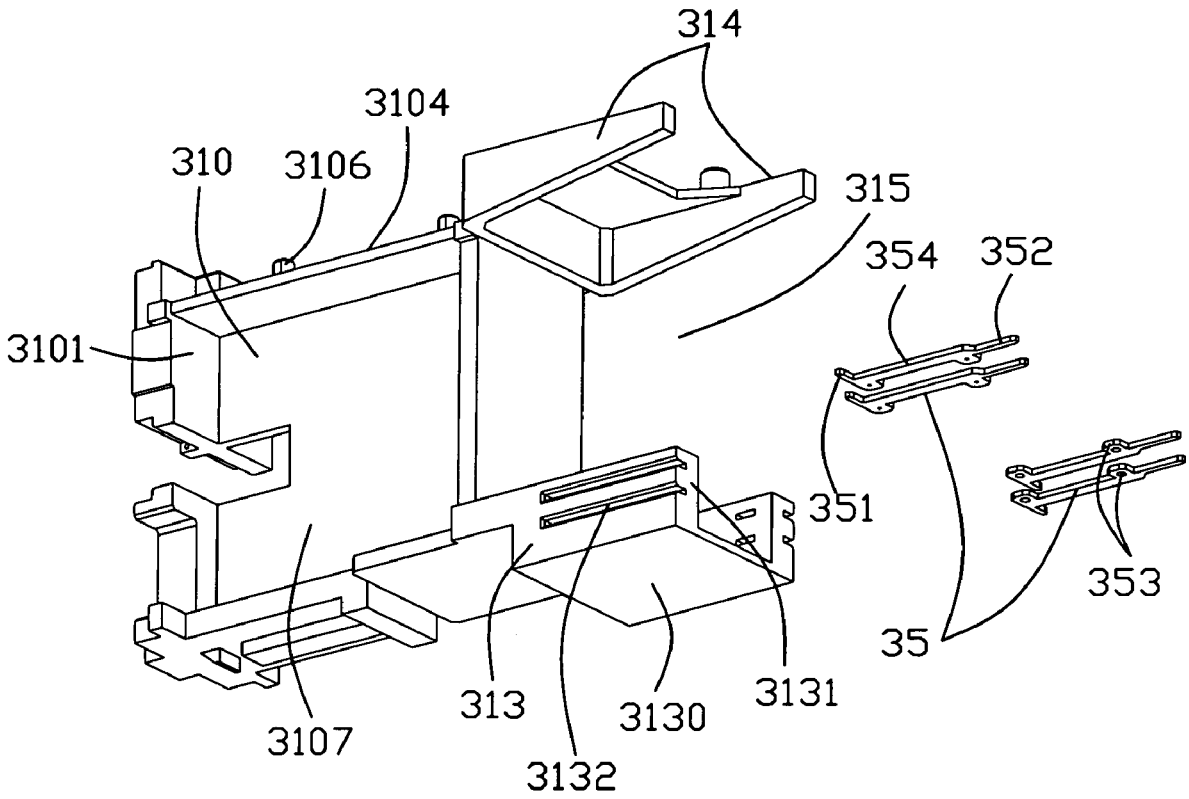
FIG. 6 is an exploded view of a base element of the terminal module as shown in FIG. 5.
Figure 7:
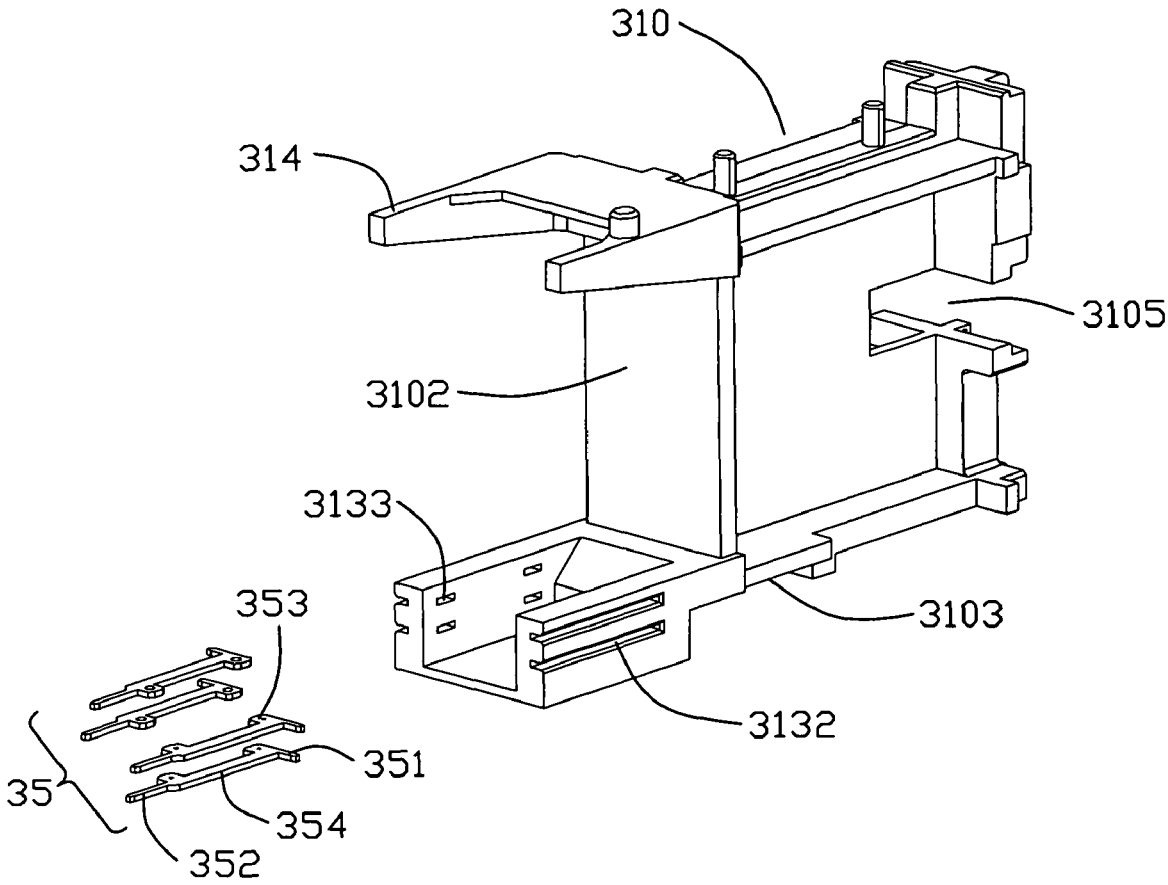
FIG. 7 is another perspective view of the base element as shown in FIG. 6.

As shown in FIGS. 5-7, the base element 310 has a front portion 3101, a top portion 3103, a bottom portion 3104, a rear portion 3102, a pair of opposite side faces 3107 and a pair of receiving rooms 3108 defined therebetween for receiving the magnetic cores 312 of the daughter boards 311. The front portion 3101 defines an opening 3105 for engaging with the rectangular housing 301 of the contacting module 30. The base element 310 further comprises a first projecting portion 313 rearwardly of the top portion 3103 and a second projecting portion 314 extending from the bottom portion 3104. A receiving space 315 is formed between the first projecting portion 313 and the second projecting portion 314 and is adapted for receiving the electrical elements 330 of the power over ethernet assembly 33. The first projecting portion 313 comprises a middle section 3130 horizontally rearwardly extending from the top portion 3103 of the base element 310 and a pair of opposite lateral walls 3131 perpendicularly downwardly extending from the middle section 3130. Each lateral wall 3131 has a pair of parallel terminal slots 3132 thereon for receiving the connecting terminals 35. The bottom portion 3104 of the base element 310 is provided with a pair of posts 3106 extending downwardly.

The connecting terminal 35 comprises a lengthwise section 354, a first end 351 extending perpendicularly from the lengthwise section 354 and exposed at a side of the first projecting portion 313, a second end 352 extending rearwardly from the lengthwise section 354 for electrically connecting with the power over ethernet assembly 33, and a plurality of protrusions 353 projecting perpendicularly from the lengthwise section 354 for interfering with the terminal slots 3132. The first end 351 extends into a first hole 3111 disposed on daughter board 311. The second end 352 extends perpendicularly outwardly from the terminal slot 3132, for electrically connecting with the power over ethernet assembly 33. An electrical connection between the daughter board 311 and the power over ethernet assembly 33 is established.

Referring to FIGS. 3, 4 and 5, the connecting element 32 is mounted below the bottom portion 3104 of the base element 310. The connecting element 32 has a base section 321 defining a pair of recesses 322 thereon for engaging with a pair of protruding posts 3106 of the base element 310, and two rows of L-shaped contacts 323 assembled to the base section 321. Each row of the L-shaped contacts 323 have soldering portions 324 soldered onto the mother board 4 and bending portions 325 extending through a plurality of third holes 3112 disposed on the daughter board 311, thereby forming a conductive trace between the daughter board 311 and the mother board 4. The third holes 3112 are defined along a lower edge of the daughter board 311 and are positioned away from the second holes 3110 for avoiding hi-pot.

Referring to FIG. 4, the modular jack assembly further comprises a grounding plate 34 defining a plurality of through holes (not shown) for extension of the L-shaped contacts 323.

Referring to FIGS. 1-7, in assembling of the module jack assembly, firstly, the connecting terminals 35 are inserted into the terminal slots 3132 in an outer-to-inner manner along a direction perpendicular to the extending direction of the lateral wall 3131. The protrusions 353 of the connecting terminals 35 interfere with the terminal slots 3132 for firmly fixing the connecting terminals 35. Secondly, the contacting module 30 is inserted into the opening 3105 of the base element 310. The connecting element 32 is mounted below the bottom portion 3104 of the base element 310 by the engagement between the protruding posts 3106 and the recesses 322. The pair of daughter boards 31 are assembled to the side faces 3107 of the base element 310 and the magnetic cores 312 of the daughter board 31 are received in the receiving room 3108. Then the power over ethernet assembly 33 is mounted to the rear portion of the base element 310 and is electrically connected with the connecting terminals 35. The terminal module 3 is assembled as a whole. The grounding plate 34 is mounted below the terminal module 3. The soldering portions 324 of the L-shaped contacts 323 extend through corresponding through holes of the grounding plate 34 for being fixed at a proper position. Thirdly, the terminal module 3 is mounted in the cavity 20 of the insulative housing 2 and then the assembly is ready to be mounted to the mother board 4. The soldering portions 324 of the L-shaped contacts 323 are soldered on the mother board 4. The outer shield 6 is attached to an outer side of the insulative housing 2 for shielding purpose. The grounding plate 34 is connected to the outer shield 6 for grounding.

The terminal module 3 is electrically connected to the mother board 4 via the electrical connection among the mating terminals 302, a conductive trace of the daughter board 311 and the L-shaped contacts 323. The terminal module 3 is electrically connected to the electrical elements 330 of the power over ethernet assembly 33 via the electrical connection among the mating terminals 302, another conductive trace of the daughter board 311 and the connecting terminals 35.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A modular jack assembly for being mounted on a mother board and engaging with a mating plug, comprising:

an insulative housing defining a cavity for receiving the mating plug;

a power over ethernet assembly having a substrate and a plurality of electrical elements mounted on the substrate; and a terminal module mounted in the insulative housing and comprising:

a base element having a plurality of terminal slots at an outer face thereof;

a plurality of connecting terminals mounted in the terminal slots, each connecting terminal comprising a first end exposed at a side of the base element and a second end connected with the power over ethernet assembly;

a pair of daughter boards attached to opposite sides of the base element and having a plurality of first holes for engaging with the first ends of the connecting terminals;

a contacting module assembled to the base element, the contacting module having two groups of mating terminals electrically connected to the daughter boards; and a connecting element assembled to the base element and comprising a plurality of contacts electrically connected to the daughter boards.

2. The modular jack assembly as claimed in claim 1, wherein said connecting terminal comprises a lengthwise section and a plurality of protrusions projecting perpendicularly inwardly from the lengthwise section for interfering with the terminal slots.

3. The modular jack assembly as claimed in claim 2, wherein said first end of the connecting terminal extends perpendicularly outwardly from the lengthwise section and the second end extends rearwardly from the lengthwise section.

4. The modular jack assembly as claimed in claim 1, wherein said daughter board defines a plurality of second holes, said each group of mating terminals has contacting portions contacting with the mating plug and tail portions engaging with the second holes.

5. The modular jack assembly as claimed in claim 4, wherein said daughter board has a plurality of third holes defined along a lower edge thereof for engaging with the contacts of the connecting element.

6. The modular jack assembly as claimed in claim 5, wherein said connecting element comprises a base section, the contacts being assembled into the base section, and wherein each contact is L-shaped and has a bending portion engaging with the second holes and a soldering portion for soldering onto the mother board.

7. The modular jack assembly as claimed in claim 1, wherein said base element comprises a first projecting portion extending rearwardly, said terminal slots being disposed in the first projecting portion.

8. The modular jack assembly as claimed in claim 7, wherein said base element comprises a front portion, a top portion, a bottom portion, a rear portion and a side face, and a receiving room defined therebetween for receiving a plurality of magnetic cores formed on the daughter board, said first projecting portion extends rearwardly from the top portion.

9. The modular jack assembly as claimed in claim 8, wherein said bottom portion of the base element has a pair of protruding posts and the connecting element comprises a pair of recesses receiving the posts.

10. The modular jack assembly as claimed in claim 8, wherein said base element further comprises a second projecting portion extending rearwardly from the bottom portion and a receiving space defined between the first projecting portion and second projecting portion for receiving the electrical elements of the power over ethernet assembly.

11. The modular jack assembly as claimed in claim 8, wherein said first projecting portion comprises a middle section horizontally rearwardly extending from the top portion of the base element and a pair of opposite lateral walls perpendicularly downwardly extending from the middle section, said terminal slots being defined on the lateral walls.

12. The modular jack assembly as claimed in claim 8, wherein said contacting module has a housing engaging with an opening disposed on the front portion of the base element.

13. The modular jack assembly as claimed in claim 1, further comprising an outer shield surrounding the insulative housing.

14. The modular jack assembly as claimed in claim 13, further comprising a grounding plate connected to the outer shield and mounted between the insulative housing and the mother board, the grounding plate defining thereon a plurality of through holes for extension of the contacts.

15. An electrical connector comprising:

an insulative housing defining opposite upper and lower plug receiving cavities;

terminal sub-assembly including upper and lower terminal modules stacked with each other disposed in the corresponding upper and lower plug receiving cavities, each of said upper and lower terminal modules including a plurality of terminals;

a pair of printed circuit boards respectively located by two lateral sides of said terminal sub-assembly and mechanically and electrically connected to the corresponding terminals of the upper and lower terminal modules, respectively;

a connection element located below the terminal sub-assembly and including two rows of contacts mechanically and electrically connected to the corresponding printed circuit boards, respectively, with mounting section extending in a first direction; and a base element holding said terminal sub-assembly, the printed circuit boards and the connection members together; wherein said base element further holds a plurality of connection terminals mechanically and electrically connected to the corresponding printed circuit boards, respectively, under a condition that each of said connection terminals has a mounting tail extending in a second direction perpendicular to the first direction.

16. The electrical connector as claimed in claim 15, wherein said contacts and said connection terminals are respectively located at a lower edge section and a rear edge section of the corresponding printed circuit board.

* * * * *